US005297360A

United States Patent [19]

Besore et al.

[11] Patent Number: 5,297,360

[45] Date of Patent: Mar. 29, 1994

[54] REFRIGERATOR CABINET WITH COMBINATION SEALING ARRANGEMENT

[75] Inventors: John K. Besore; Helen M. Denham, both of Louisville, Ky.

[73] Assignee: General Electric Company, Louisville, Ky.

[21] Appl. No.: 932,801

[22] Filed: Aug. 20, 1992

[51] Int. Cl.[5] ..... E06B 7/16

[52] U.S. Cl. ..... 49/484.1; 49/478.1; 49/479.1; 49/492.1

[58] Field of Search ..... 49/475, 478.1, 484, 49/485, 488, 487, 492, 495, 498, 479.1, , 484.1, 475.1, 492.1, 495.1, 498.1; 312/236; 62/275

[56] References Cited

U.S. PATENT DOCUMENTS

| | | | |
|---|---|---|---|
| 1,980,005 | 11/1934 | Seeger et al. | 49/487 |
| 2,591,003 | 4/1952 | Philipp | 49/487 |
| 2,663,916 | 12/1953 | Millman | 49/487 |
| 2,801,450 | 8/1957 | Funke | 49/493 |
| 3,276,167 | 10/1966 | Bus et al. | 49/485 |
| 3,603,035 | 9/1971 | Kaldenberg | 49/485 |
| 4,644,698 | 2/1987 | Gerdes et al. | 49/493 X |
| 4,891,912 | 1/1990 | Bockwinkel | 49/484 |
| 5,107,622 | 4/1992 | Fuchs et al. | 49/489 |
| 5,117,587 | 6/1992 | Doan | 49/475 X |

*Primary Examiner*—Peter M. Cuomo
*Assistant Examiner*—Michael Milano
*Attorney, Agent, or Firm*—H. Neil Houser

[57] ABSTRACT

A refrigerator cabinet includes a storage compartment defined by encased walls forming a peripheral edge surface surrounding the access opening. A door is hingedly mounted adjacent one edge and includes a resilient sealing gasket to seal the opening. A resilient flap is mounted on the inner panels of the walls or on the opposed liner panel of the door so that an auxiliary seal is formed separate from the gasket. An extended dead air space is provided between the flap, gasket and the opposed panels so that heat transfer from the area of the gasket into the compartment is substantially eliminated. The elongated body of the flap is approximately 70 Shore A Durometer hardness, and the base is approximately 70 Shore D Durometer hardness of a suitable plastic, such as polyvinylchloride. In one embodiment, the cross-section of the body takes the form of a bulb with a substantially semicircular cross-section, and in another embodiment, the body takes the form of a spike in cross-section with a convergent 5° angle from the base. Corner sealing inserts attach to the adjacent ends of the wipers.

4 Claims, 2 Drawing Sheets

Fig. 3
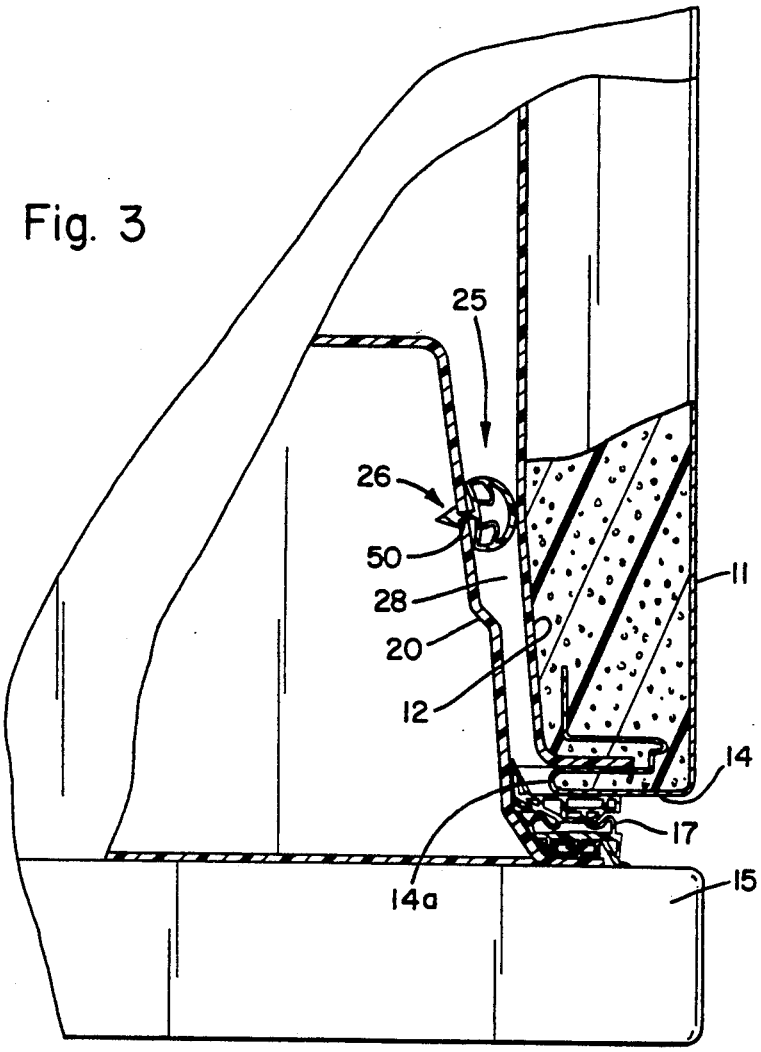
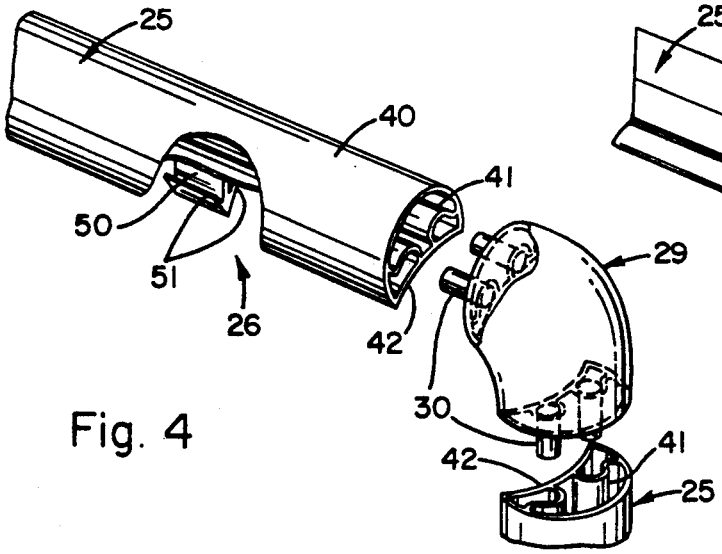
Fig. 4
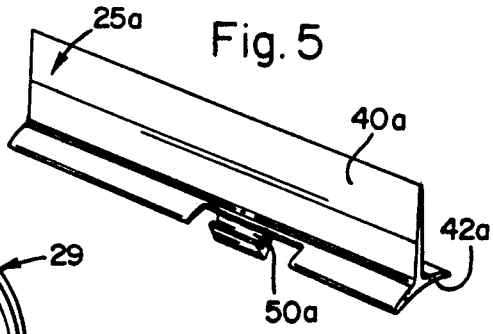
Fig. 5

REFRIGERATOR CABINET WITH COMBINATION SEALING ARRANGEMENT

TECHNICAL FIELD

The present invention relates to refrigerator/freezer cabinet structure and, more particularly, to a cabinet having an improved sealing arrangement for reducing the energy loss around the gasket of the door.

A related case is U.S. patent application Ser. No. 07/932,800 filed Aug. 20, 1992 entitled "Refrigerator Cabinet With Combination Sealing Arrangement Including Breaker Panels," assigned to the present assignee.

BACKGROUND OF THE INVENTION

It is well known that the requirements for improved cabinet insulation and sealing the door/cabinet interface in refrigeration appliances are becoming more and more stringent. In order to comply with the United States Department of Energy standards to reduce energy consumption in the coming few years, substantial improvements must be made. However, in order to keep the cost of manufacture of refrigerators and freezers as low as possible, it is, of course, desirable to maintain as much of the prior cabinet design as possible as the improvements are made. With this as a given factor, the most likely source for energy saving improvements and revisions involves the elimination of heat leakage around the door gasket into the storage compartment.

There have been numerous attempts to do this by improvement to the gasket construction itself, such as shown in the Swerbinsky U.S. Pat. No. 4,653,819, issued Mar. 31, 1987, and assigned to the assignee of the present invention. The approach in this prior art reference is primarily to direct the face of the magnetic gasket in a direction as it approaches the peripheral edge surface of the encased walls of the cabinet so that the gasket is not distorted during closing of the door. Other arrangements providing improvements in the structure of the gasket itself, as well as the mounting arrangement on the periphery of the door, defines a main focal point of thinking among refrigeration appliance engineers.

In the prior art patent '819, there is an incidental suggestion that air insulating spaces positioned between the peripheral edge surface of the encased walls and the corresponding face of the door play a role in stopping heat leakage. It has been found, however, that these relatively small captive spaces found very limited additional improvement in the abatement of the heat leakage problem. First, the spaces are formed by parts of the gasket itself so that there still remains a direct conducting heat flow path through the gasket structure itself from outside the compartment to the inside. It has been proven that this direct heat conduction path provides significant heat leakage, and is not prevented by the insulating spaces suggested in the patent. Furthermore, the spaces are all defined by movable parts of the sealing gasket and depend on contact that is governed by the seating of the magnetic seal. In other words, the spaces are formed only as a secondary consideration and any variation in the magnetic seal engagement, such as due to wear, can actually cause the spaces to open up and thereby eliminate any advantage whatsoever.

Another main path of heat conduction is by means of the projection of the case flange into the refrigerated compartment where the flange is subjected to compartment air flow.

By this invention, there is provided a refrigerator cabinet which includes a gasket and a separate auxiliary flap extending between the inner panels of the walls and the liner panel of the door to significantly cut down on heat leakage, and thereby substantially increase the sealing efficiency.

SUMMARY OF THE INVENTION

A refrigerator cabinet includes a storage compartment having an access opening surrounded by a peripheral edge surface against which the resilient sealing gasket on the door engages for sealing. The walls of the cabinet include inner panels extending inwardly from the peripheral edge surface. A corresponding liner panel on the door extends inwardly within the compartment a sufficient distance around the periphery so that when the door is closed, an opposed panel relationship is provided. This relationship forms a partial dike against heat transfer from the area of the gasket into the storage compartment.

According to the present invention, a resilient flap is positioned on at least one of the inner panels, or on the liner panel of the door, for sealingly engaging the opposed panel when the door is closed. This flap is separate from the gasket, and forms an extended dead air space in cooperation with the gasket, as well as both of the opposed panels. Ideally, a flap extends along all sides of the opening including the corners. As a result, the heat leakage paths into the storage compartment and, thus, the heat transfer from the area of the gasket is substantially eliminated. In addition, the flap structure in conjunction with the opposed panels provide a dam or break protecting the inturned flanges of the outer metal cabinet from refrigerated compartment air flow. This results in significantly improving the sealing efficiency, and thus the overall energy saving efficiency rating for the refrigerator cabinet.

Preferably, the flap includes an elongated wiper of elastomeric material, such as can be easily formed of extruded plastic. An integral base includes a lock means for attaching the flap to the selected panel. The wiper is most efficiently fabricated by extrusion of the two materials simultaneously through a single die. An elastomeric material of choice is ABS plastic, although other plastics, such as polyvinylchloride (PVC), or natural or synthetic rubber, can be used.

A preferred embodiment of the flap takes the form of an elongated bulb defined by a substantially semicircular cross-section. In this preferred embodiment, internal webs provide support for the configuration of the base of bulb while the portion of the bulb beyond the webs is very flexible to assure a substantially tight fit with the opposed panel.

In an alternative embodiment of the flap, the body has a spike-like cross-section defined by an approximately 5° converging angle from the proximal end. An integral base of extruded, semi-rigid elastomeric material is provided to provide a firm mounting and efficiently hold the flap in sealing position. The base includes a winged dart with arms diverging from the tip toward the flap for secure mounting and locking in an opening on the panel. Conveniently the ends of the flaps may be cut at angles so they meet in mitered corners. Alternatively, the corner inserts for either embodiment are designed to include the same sealing cross-section and are supported in any suitable manner from the adjacent flaps, such a insert pins or the like.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 3 is an enlarged cut-away cross-sectional view showing the door of FIG. 2 with the sealing flap on the liner panel engaging the inner panel of the cabinet in the door closed position;

FIG. 4 is an enlarged, partially broken away and exploded perspective view of one embodiment of the resilient auxiliary sealing flap and the optional corner insert of the present invention, the body of the flap and insert having a semicircular cross-section; and FIG. 5 is a similar enlarged perspective view of an alternative embodiment of the sealing flap of the present invention, and including a spike-like body in cross-section.

Reference will now be made in detail to an illustrative embodiment of the invention, an example of which is illustrated in the accompanying drawings.

DESCRIPTION OF THE PREFERRED EMBODIMENT

Figure 1:
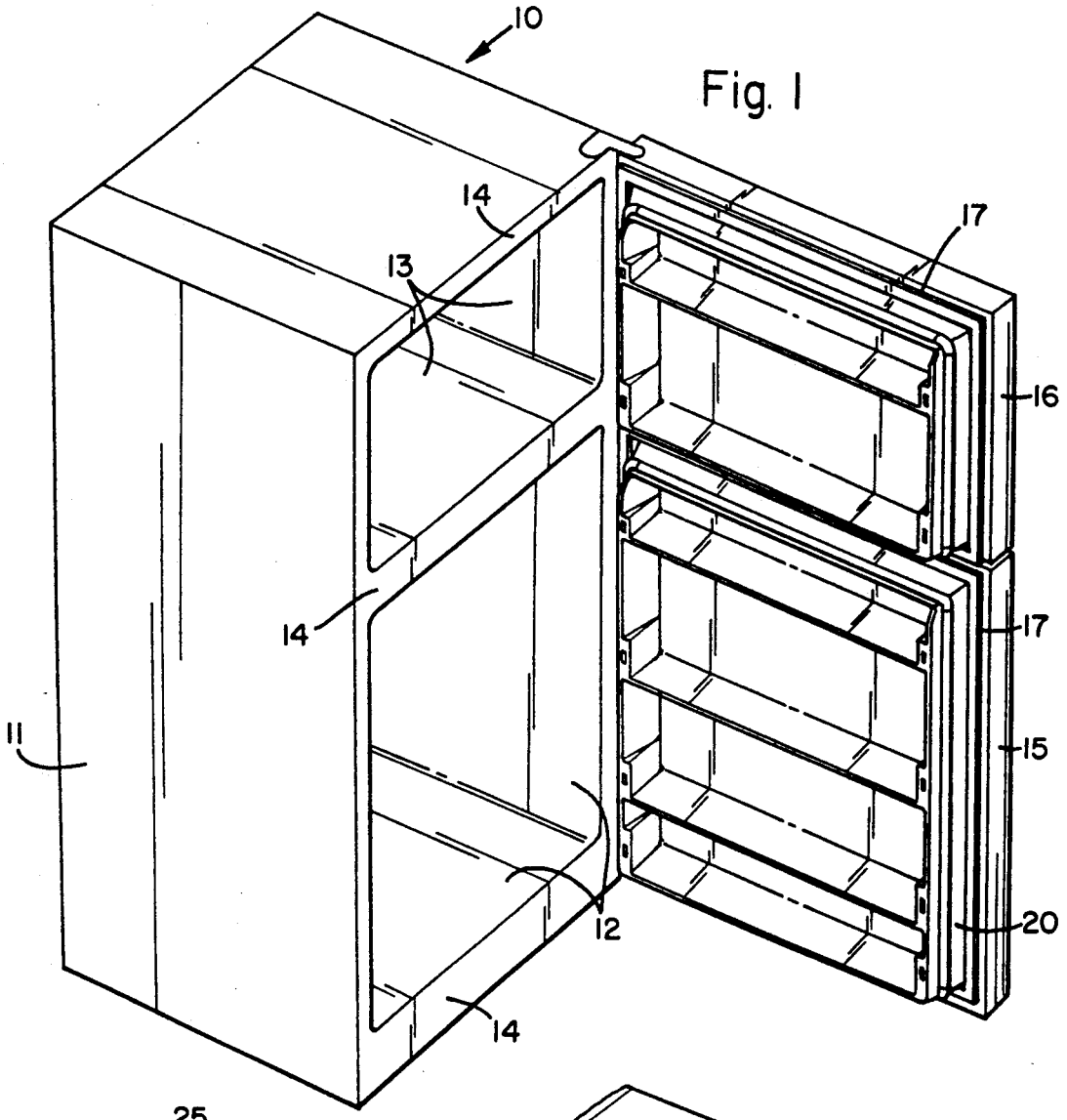
FIG. 1 is a simplified perspective view of a complete insulated refrigerator appliance, including over-and-under freezer and refrigerator storage compartments and incorporating the improved sealing arrangement of one embodiment of the present invention.

Referring to FIG. 1 of the drawings in particular, there is illustrated a refrigerator including a cabinet, generally represented by the reference numeral 10, and comprising an outer metal shell 11 defining encased walls including plastic inner panels 12, 13 defining the corresponding refrigerator and freezer storage compartments. The encased walls form inwardly projecting flanges defining a peripheral edge surface 14 extending around and defining the corresponding access openings. A refrigerator door 15 and a freezer door 16 are hingedly mounted on the cabinet 10 adjacent one edge to close the respective storage compartments. A conventional magnetic, resilient sealing gasket 17 is mounted around the inside edge of each of the doors 15, 16. As is well known, the sealing gasket is attracted to the magnetic surface typically formed by metal that defines the peripheral edge surface 14. Since the sealing arrangement for both the refrigerator door 15 and the freezer door 16 is the same with respect to the present invention, the description that follows focuses only on the structure relating to the door 15; it being understood that the same sealing arrangement is used on the door 16. Also, it is to be understood that the arrangement applies not only to an over-and-under or top mount compartment arrangement illustrated in FIG. 1, but is likewise applicable to the common side-by-side arrangement of refrigerator/ freezer.

As illustrated, the plastic inner panels 12, 13 extend inwardly from the peripheral edge surface 14. A suitable plastic for the panels 12 is ABS plastic, although other plastics, such as polyvinylchloride (PVC), may be utilized. Likewise, a vacuum formed plastic liner panel 20 is provided on the door 15 and extends inwardly within the refrigerating compartment when the door is closed. The liner panel 20 provides additional shelf space within the compartment, as is typical (see FIG. 1). Of importance to the present invention is that the liner panel 20 extends inwardly a sufficient distance around the periphery of the access opening so that when the door 15 is closed, a semi-enclosed space or partial dike against heat transfer is formed. As will be seen below, the concept of the present invention builds on this semi-enclosed space between the liner panel 20 and the inner panel 12, which in the preferred embodiment is along all four sides of the access opening; i.e. an improvement in restricting heat transfer from the area of the gasket 17 into the compartment is achieved. To put it another way, the restricted area between the opposed panels tends to prevent the cold air within the refrigerator compartment from freely migrating outwardly toward the area around the gasket 17 and from freely impinging on the metal flange or peripheral edge 14; and it is within this restricted area that the improvement of the present invention is focused.

Figure 2:
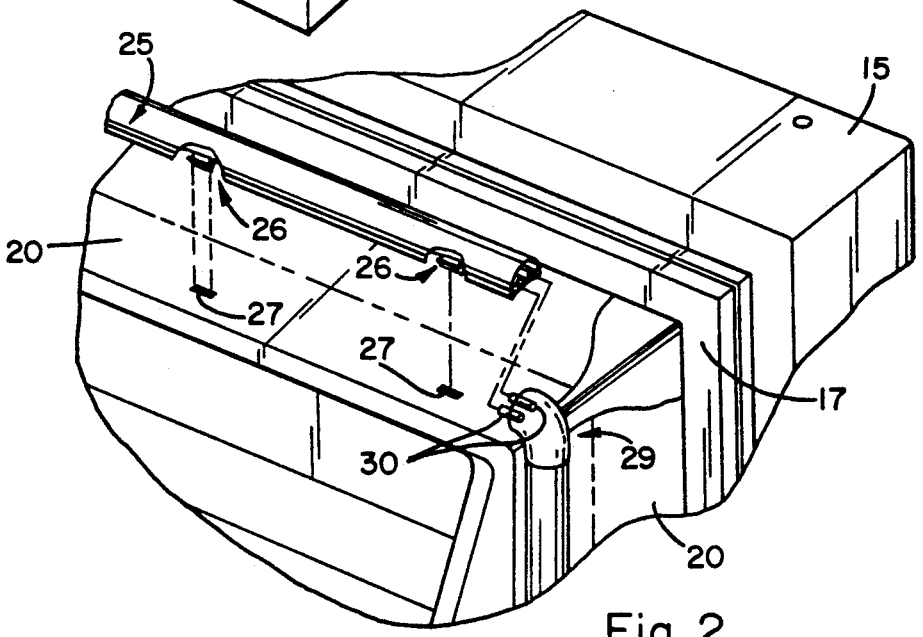
FIG. 2 is an enlarged cut-away view of the corner of one of the doors illustrated in FIG. 1 showing in exploded relationship the auxiliary sealing flaps and corner insert for two sides of the liner panel of the door.

With specific reference to FIG. 2, a resilient, elongated flap 25 is provided on two sides of the liner panel 20 for the purpose of sealingly engaging the opposed inner panels 12 during closing of the door 15. As illustrated, the flap 25 includes lock means, generally designated by the reference numeral 26, for engagement in spaced apertures 27 within the panel 20, as will be more fully described below.

As illustrated, the flap 25 is spaced inwardly from the edge of the liner panel 20 and is separate from the gasket 17. As a result, there is advantageously formed an extended dead air space in cooperation with the gasket 17 and both of the opposed panels 12, 20, as best shown at 28 in FIG. 3. This dead air space 28 provides the desired increased insulation.

Thus, it can be seen that the combination of the gasket 17 and the flap 25, in accordance with the present invention, inhibits heat transfer from the area of the gasket into the storage compartment. In addition, engagement of the flaps 25 with the inner panel 12 substantially prevents the refrigerated air within the refrigeration compartment from impinging upon the nose 14*a* of the metal flange 14, which is inside the gasket 17. To put it another way, the extended isolated air space 28, in combination with the basic, state-of-the-art gasket 17, eliminates significant heat leakage into the storage compartment. Conversely, the cold air within the compartment is not allowed to move into contact with the gasket 17 and metal flange 14, and thus the energy loss that is experienced in a cabinet having only a standard peripheral gasket 17 is overcome.

While only two flaps are shown in FIG. 3, it will be understood that, to make the combination sealing arrangement complete, the dead air space is preferably in the form of a completely surrounding, annular space by employing one of the elongated flaps along each side of the liner panel 20. The flaps may abut each other with mitered or other corners. Alternatively, a corner insert, generally designated by the reference numeral 29, maybe provided to interconnect the adjacent ends of the flaps 25 (see FIGS. 2 and 4) to form a full perimeter auxiliary seal, and assures the formation of the corresponding full perimeter, annular dead air space 28.

As can also be seen in FIG. 4, the corner insert includes a sealing flap structure similar to that of the flap 25, but simply mitered to make the corner. Suitable pins 30, extending from the two ends of the corner insert 29, are received within corresponding apertures in the ends of the flaps 25 in order to lock them in position.

The flap 25 itself is preferably extruded of elastomeric material, such as relatively ABS plastic soft PVC plastic, or natural or synthetic rubber. Preferably the thickness of the flap material is maintained at the minimum acceptable to enhance the flexibility of the portion of the flap engaging the corresponding inner panel.

As illustrated, the flap 25 takes the form of an elongated wiper having a substantially bulb-like shape and, more specifically, a semicircular cross-section, as best shown in FIG. 4. This body 40, of relatively soft ABS plastic, is supported by integral webs 41, such as shown in FIG. 4. Integrally formed with the body 40 and the webs 41 is a base 42. The webs 41 are also relatively soft, highly resilient plastic, while the base 42 is preferably semi-rigid ABS. The base 42 assures stability of the bulb-like body 40 as it wipes against the opposed panel 12 during closing (see FIG. 3), as well as providing stability during the performance of the sealing function once the door 15 is fully closed.

The lock means 26 may also be formed integrally with the flap 25, and specifically it is integral with the base 42 (see FIG. 4). The lock means 26 preferably takes the form of a winged darts 50 having opposed wings 51 extending outwardly from a distal tip. During installation on the liner panel 20, the wiper 25 is simply pressed into position, with the tip moving into the aperture 27. Next, the wings 51 are flexed so as to assure entry into the aperture 27 and then they spring outwardly to the locking position once the full thickness of the panel is penetrated (see also FIG. 3). As best seen in FIG. 4, the base 42 initially is concave upwardly. This enables the central portion of the base to flex downward during installation to accommodate different thicknesses of liner. Of course, the resiliency of the wings 51 holds the base 42 in firm engagement with the liner panel 20 so as to fully seal each of the spaced apertures 27.

The resilient, bulb-like body 40 supported by the resilient webs 41 incorporates sufficient elastic memory in order to return to its uncompressed state (see FIG. 4) each time the door 15 is opened. This assures that the full sealing engagement illustrated in FIG. 3 is accomplished each time the door is closed. Preferably, the thickness of the flap 25 relative to the space between the opposed panels 12, 20, and the wiping relationship of the flap 25 against the opposed panel 12, is such that a full auxiliary seal occurs just before the full seal occurs around the gasket Preferably, the flap 25 is extruded all in one operation. This is done by injecting the relatively soft ABS plastic into the die to form the body 40 and the supporting webs 41, while similar semi-rigid plastic is injected to form the base 42 and the integral winged darts 50.

With reference now to FIG. 5 of the drawings, an alternative embodiment of the elongated flap for providing the combination sealing arrangement of the present invention is illustrated; like elements including the same reference numeral as in the other FIGURES, but with the additional suffix "a" for further identification. Specifically, a resilient, elongated flap 25*a* comprises a spike-like body 40*a* having convergent sides extending at an angle of approximately 5° from its proximal end, that is from base 42*a*. Integral with the base is the inverted dart 50*a* to lock the flap 25*a* in position on the liner panel 20 of the door 15.

The flap 25*a* operates in the same manner as the flap 25: that is, with the distal edge or tip engaging the opposed panel 12, as can be visualized by viewing FIG. 3, the tapered tip wipes along and seals against the surface of the panel 12, flexing progressively as the closing of the door proceeds The annular space provided by the combination of the flap 25*a*, the gasket 17 and the panels 12, 20 thus maximizes the isolation of any heat that might leak past the gasket 17 and the heat transfer through the peripheral edge or flange 14. Thus, the combination sealing arrangement of the present invention provides the maximum energy saving coefficient for the refrigerator/freezer cabinet 10, that is otherwise a standard design.

While the elongated flaps 25, 25*a* are shown and described as being mounted on the liner panel 20, it should be noted that within the broad aspects of the present invention, they could equally well be mounted on the inner panel 12 of the encased walls. Similarly, one or both of the flaps 25, 25*a* could be used together in tandem to increase the sealing efficiency.

In summary, it will be realized that the insulated refrigeration appliance of the present invention provides substantial results and advantages over the prior art. The combination sealing arrangement of the resilient, elongated flaps 25, 25*a*, the corner inserts 29 and the resilient sealing gasket 17 inhibits the transfer of heat to the storage compartment of the cabinet 10. Advantageously, the annular dead air space 28 provides the added insulation needed to enhance the energy saving coefficient so that the stringent requirements of today and years to come can be met. Since the annular space 28 is substantially extended, and there is no direct interconnection with the gasket 17 and the peripheral edge 14, there is simply more heat kept out of the sealed compartment and, conversely, more cold kept in.

Solid wiping contact between the flaps 25, 25A and the inner panels 20 provides the maximum seal and energy savings. However, such contact increases the force needed to close and open the door. Alternatively, in some applications it may be desirable to limit the contact force or interference between the flaps 25, 25A and the liner panels 20. At the extreme, a very slight gap might be maintained between the elements. While such a slight gap would still provide an air flow seal significantly impeding air flow and heat transfer, it would sacrifice some energy savings in favor of ease and certainty of full door closure.

While, in accordance with the patent statute, there is described herein what at present is considered to be the preferred and alternative embodiments of the sealing arrangement of the invention, it will be obvious to those skilled in the art that various changes and modifications may be made without departing from the invention. It is, therefore, intended by the appended claims to cover all such changes, modifications and equivalent structure, as fall within the true spirit and scope of the invention.

We claim:

1. A household refrigerator comprising:

a cabinet having an outer metal shell including an inwardly projecting peripheral flange extending around and defining an access opening;

a plastic inner liner defining a refrigerator storage compartment, said liner being received within said shell with thermal insulation therebetween, said inner liner including inner liner panels extending inwardly from the distal edge of said peripheral flange;

a door hingedly mounted on said cabinet adjacent said access opening and movable between a closed position over said opening and an open position exposing said opening;

a resilient sealing gasket carried by said door and engaging said peripheral flange when said door is in its closed position to seal the opening between said door and flange;

a plastic door liner panel mounted on the compartment side of said door and providing additional storage shelves; when said door is in its closed position, said door liner panel being positioned closely adjacent said inner liner panels around the periphery of said inner liner and extending into said compartment a sufficient distance that said inner liner panels and said door liner panel define a semi-enclosed space of restricted area forming a partial dike which tends to prevent cold air within the refrigerated compartment from migrating freely toward the gasket and from impinging upon said peripheral flange of said metal shell;

a resilient, elongated flap having an elongated wiper of elastomeric material integrally molded to have a relatively soft body and a simi-rigid base mounted on at least one of said inner liner panels and said door liner panel substantially removed from said peripheral flange, said flap engaging the opposed one of said inner liner panels and said door liner panel as said door moves to its closed position to form an air flow seal therebetween so that the portion of said semi-enclosed space of restricted area between said resilient gasket and said flap becomes an extended dead air space;

whereby heat transfer between the interior of said refrigerated compartment and the area of said peripheral flange and resilient gasket is substantially eliminated.

2. The refrigerator of claim 1 wherein said body of said elongated flap has a convergent, approximately 5° angle from its proximal end.

3. The refrigerator of claim 1, wherein said semi-rigid base of said flap is firmly and attachably mounted on said at least one panel, and said body of said flap engages the opposed panel for sealing there against.

4. The refrigeration appliance of claim 3, wherein said base of said flap includes at least one winged dart with arms diverging from the tip toward the flap for mounting in an opening on said panel.

* * * * *